US010400375B2

(12) United States Patent
Gentner

(10) Patent No.: US 10,400,375 B2
(45) Date of Patent: Sep. 3, 2019

(54) ACCESSORIES BOX FOR A SEWING MACHINE

(71) Applicant: BERNINA International AG, Steckborn (CH)

(72) Inventor: Robert Gentner, Radolfzell (DE)

(73) Assignee: BERNINA INTERNATIONAL AG, Steckborn (CH)

( * ) Notice: Subject to any disclaimer, the term of this patent is extended or adjusted under 35 U.S.C. 154(b) by 271 days.

(21) Appl. No.: 15/337,571

(22) Filed: Oct. 28, 2016

(65) Prior Publication Data

US 2017/0152618 A1 Jun. 1, 2017

(30) Foreign Application Priority Data

Nov. 26, 2015 (CH) ..... 1725/15

(51) Int. Cl.
*D05B 91/12* (2006.01)
*D05B 73/00* (2006.01)

(52) U.S. Cl.
CPC ..... *D05B 91/12* (2013.01); *D05B 73/00* (2013.01)

(58) Field of Classification Search
CPC ..... D05B 91/12; D05B 73/00–73/12
USPC ..... 312/308.5, 308.6
See application file for complete search history.

(56) References Cited

U.S. PATENT DOCUMENTS

| | | | | | |
|---|---|---|---|---|---|
| 2,891,349 | A * | 6/1959 | Ketterer | D05B 77/00 112/217.1 |
| 3,373,709 | A * | 3/1968 | Gubbay Jacob D | D05B 73/12 112/260 |
| 3,751,130 | A * | 8/1973 | Fresard | A45C 11/00 312/244 |
| 4,966,089 | A * | 10/1990 | Hanyu | D05B 73/00 112/258 |
| 5,775,245 | A * | 7/1998 | Sato | D05B 73/12 112/260 |
| 2011/0191988 | A1 | 8/2011 | Wein et al. | |
| 2018/0245256 | A1* | 8/2018 | Capt | D05B 27/22 |

FOREIGN PATENT DOCUMENTS

| | | | | |
|---|---|---|---|---|
| CH | 707972 | | 10/2014 | |
| CN | 204223062 | | 3/2015 | |
| DE | 9100138 | | 4/1991 | |
| DE | 102006012096 | | 9/2007 | |
| GB | 954668 | A * | 4/1964 | D05B 35/02 |
| JP | S5077040 | | 7/1975 | |
| JP | H02122677 | | 5/1990 | |
| JP | H0456481 | | 2/1992 | |

* cited by examiner

*Primary Examiner* — Danny Worrell
(74) *Attorney, Agent, or Firm* — Volpe and Koenig, P.C.

(57) ABSTRACT

An accessories box (10) for a sewing machine (20) having a fastening device (30). The accessories box (10) has a bottom element (11), which is designed to bear against a base (21) of a housing (22) of the sewing machine (20). The bottom element (11) includes a recess (12), in which the fastening device (30) is received, the fastening device (30) contains a magnetic or magnetizable element (13) and/or a mating element (23).

11 Claims, 7 Drawing Sheets

ACCESSORIES BOX FOR A SEWING MACHINE

INCORPORATION BY REFERENCE

The following documents are incorporated herein by reference as if fully set forth: Swiss Patent application No, 01725/15, filed Nov. 26, 2015.

BACKGROUND

The subject matter of the invention is an accessories box for a sewing machine as well as a system containing a sewing machine and an accessories box.

Accessories boxes for sewing machines are known. The accessories box on the sewing machine serves to keep accessories for the operation of a sewing machine, such as presser feet, spools or needles, in an ordinary fashion.

There are accessories boxes in the form of boxes which are kept separate from the machine, such as a sewing kit as shown in DE9100138U. This document shows a magnetic needle fastening in a sewing kit, by which various sewing needles can be secured. Thanks to the securing, the sewing needles can be located quickly and the risk of injury to the user from loose lying sewing needles is reduced. However, the fastening of larger parts by magnets has a drawback, which this fastening variant entails, namely, the weak holding force when subjected to shearing forces. For small, loose parts such as the needles of DE9100138U this is not a factor, but for large, bulky, heavy objects such as accessories boxes no fastening of the latter by means of magnets has been proposed thus far.

Such accessories boxes, which are connected to a portable or transportable machine, are known not just in the field of sewing machines. For example, CN204223062U shows an accessories box which is accommodated in a housing of a motor scooter. Such accessories boxes can be used to store tools which may be needed for the operation of the machine. Therefore, when a machine is transported, the right tool to operate the machine or fix simple malfunctions of the machine on site is always available thanks to the accessories box which is carried along. CN204223062U shows a magnetic holding device for a lid of the accessories box. But the lid remains constantly connected to the housing of the motor scooter by a hinge element, so that when the lid is closed the magnets located there are exactly aligned with the magnets located in the housing.

Accessories boxes are also used for sewing machines, which can be fastened to the sewing machine so that they can be transported with the sewing machine, especially for portable sewing machines for household use.

Such an accessories box can be arranged on the rear of the sewing machine when it is not in use. Before the sewing machine is placed in operation, the accessories box is released from the sewing machine and set up on the work table or secured to a wall.

Such an accessories box is fastened to the rear side of the sewing machine when the sewing machine is out of operation. For this, such accessories boxes usually have mechanical fastening means, such as snap connections, which have locking means. Such locking means are usually made of plastic and are manually opened or closed by the user applying a pressing force. Due to the many possible locking means and their different modes of operation, the user can make a mistake when using them. If too great a force is applied in the wrong direction to the locking means due to such a mistake, the locking means can become ruined. A damaged locking means generally results in impaired functionality, if not unusability of the entire accessories box.

The currently used locking means also comprise projecting locking elements, which can likewise get broken off by careless handling, so that the accessories box becomes unusable or loses at least part of its use, as it can no longer be fastened for transport and storage to the sewing machine. Projecting locking means on the underside of the accessories box can furthermore impair the stability of the accessories box. The accessories box is placed on the work table and allows the user while working at the sewing machine to exchange individual parts such as needles, spools, presser feet or the like and stow away the no longer used parts. Therefore, one design requirement of the accessories box is that it can be placed in the most stable manner possible on a level base, such as a work table, and it therefore requires a corresponding standing surface. Projecting bolts or other locking means reduce the standing surface. Furthermore, projecting bolts or feet have the drawback of making the manufacture of the accessories box more costly. Of course, it is possible to arrange the locking means with corresponding projections on the sewing machine. But such a variant is not advantageous if these locking means come into contact with the fabric, which can get caught on these locking means and suffer damage. In particular, the area of the free arm of the sewing machine should therefore be kept free of projections such as bolts, locking means, or the like. Therefore, if possible, no projecting locking means should be arranged on the sewing machine.

The option also exists to provide a locking mechanism in addition or as an alternative to the locking means. A locking mechanism comprises at least one movable bolt, which can be introduced by the user into a corresponding recess and in this way the accessories box can be fastened to the sewing machine. Such a bolt has basically the same drawbacks as a locking mechanism. In addition, the bolt must be led in a bolt guiding element. Therefore, an extra structural part is required with this variant, which can increase the manufacturing costs of either the accessories box or the sewing machine.

SUMMARY

The need therefore exists for an improved device for the fastening of an accessories box to a sewing machine which does not have the drawbacks of the prior art.

Furthermore, the need exists for an accessories box which can be used whenever possible for several sewing machines, possibly also those of different design. In particular, the accessories box should be usable for sewing machines of different structural length.

Now, one objective that is achieved by the present invention is to provide an accessories box for a sewing machine which can be set up in a stable manner on a level base, which can easily be detached from the sewing machine and again connected to the sewing machine so that it can be transported along with the sewing machine. Another objective which the invention achieves is to create an accessories box with a fastening device that has no projections. Another objective achieved by the invention is to create a base for a sewing machine which has no projections.

These objectives are achieved by an accessories box according to one or more features of invention and by a system comprising an accessories box and a sewing machine with one or more features as disclosed herein. Special example embodiments of the invention are the subject matter of the dependent claims.

An accessories box for a sewing machine comprises a fastening device, wherein the accessories box comprises a bottom element, which is designed to bear against a base of the sewing machine. The bottom element comprises a recess, in which the fastening device is received, the fastening device containing a magnetic element or a magnetizable element and/or a mating element.

In particular, the magnetic element or the magnetizable element or the mating element can be held in the recess, while the magnetic element or the magnetizable element or the mating element is in particular movable in the recess, in particular it is slidable. The mating element can be moved by the magnetic element or magnetizable element into the recess, or the mating element can be moved by the magnetic element or magnetizable element out from the recess, so that the position of the accessories box can be defined in relation to the sewing machine.

The accessories box can comprise a first wall element and a second wall element, the first wall element being arranged opposite the housing of the sewing machine, while a fastening device is arranged on the housing for the fastening of the accessories box.

In particular the invention encompasses a system as well as a sewing machine and an accessories box according to one of the aforementioned example embodiments. The mating element can contain a magnet or a ferromagnetic region.

According to one example embodiment, the mating element is received in the base of the sewing machine. According to one example embodiment, the mating element is held in a recess of the bottom element of the accessories box.

According to one example embodiment, the mating element is led through a housing borehole of the housing or through the recess of the bottom element, so that the mating element is movable along the lengthwise axis, in particular it is slidable. The lengthwise axis extends in particular in the vertical direction.

According to one example embodiment, the mating element comprises a body element and a head element, wherein the cross section of the head element is oriented normal to the lengthwise axis of the mating element. In particular, the mating element can take up a locking position when the accessories box is positioned on the base so that the magnetic element or the magnetizable element is arranged substantially along the lengthwise axis so that the mating element can be attracted by the magnetic element or magnetizable element. In particular, the mating element can be received in the recess. According to one example embodiment, the mating element can take up an unlocking position when the accessories box is removed from the base, while the mating element in the unlocking position does not extend beyond the cover surface of the base or the bearing surface of the bottom element.

According to one example embodiment, the fastening device can contain a spring element. The spring element can be designed in particular as a spiral spring. The spring element can enclose the body element of the mating element. The spring element can be arranged between the head element of the mating element and the inner wall of the base or be arranged between the head element of the mating element and the inner wall of the bottom element of the accessories box. The spring element can be biased in the locking position by having the mating element be attracted by the magnet or magnetizable element. In the biased state, the spring element can have its shortest length. The spring element can be in the relaxed state in the unlocking position. In the relaxed state, the spring element has its maximum length. Thanks to the restoring force of the spring element, that is the relaxation of the spring element, the mating element can be received in the recess of the bottom element or the base so that it does not extend beyond the bearing surface of the bottom element or the cover surface of the base.

According to one example embodiment, the accessories box comprises a first wall element and a second wall element, wherein the first wall element is arranged opposite to the housing of the sewing machine, and a fastening device is arranged on the housing for the fastening of the accessories box.

The activation of the fastening device, which connects the accessories box to the sewing machine, especially its base, is simple and intuitive. The activation of the fastening device cannot result in overstraining of individual elements of the accessories box or its fastening mechanism, since the fastening device comprises no projections such as bolts, wedges or the like, which can break off or which might damage the material being sewn. In particular, the accessories box can be placed without additional feet in a standing configuration on a level surface, such as a work table.

The fastening device also does not have any snap elements which are received for example by spring force or pretensioning in a corresponding mating element, so that an overstraining and possible failure of these snap elements can be ruled out, thereby extending the useful life of the accessories box.

The work area is free of locking elements, snap elements, or locking means, so that the fabric can be moved unhindered across the entire work surface. In particular, this makes possible a high-quality design of the housing of the sewing machine, which is free of projecting elements.

The accessories box as well as the system are universally usable on different models of sewing machines.

For the manufacture of the housing of the sewing machine and the accessories box, the tolerance requirements can be reduced as compared to the traditional fastening devices by means of snap connections, so that the installation expense during production and service is less, and a saving in time and costs is possible. Furthermore, clattering noise due to parts knocking together can be avoided.

BRIEF DESCRIPTION OF THE DRAWINGS

The invention shall be explained more closely by means of illustrated example embodiments. There are shown FIG. 1 a perspective representation of an accessories box as well as a sewing machine, FIG. 2 a view of a sewing machine with accessories box, FIG. 3 a section through a sewing machine and the accessories box, FIG. 4 a first detail of FIG. 3, FIG. 5 a second detail of FIG. 3, FIG. 6 a detail of a second example embodiment of a fastening device in the locking position, FIG. 7 a detail of a second example embodiment of a fastening device in the unlocking position, FIG. 8 a detail of a third example embodiment of a fastening device in the locking position, FIG. 9 a detail of a third example embodiment of a fastening device in the unlocking position, FIG. 10 a detail of a fourth example embodiment of a fastening device in the locking position, and FIG. 11 a detail of a fourth example embodiment of a fastening device in the unlocking position.

DETAILED DESCRIPTION OF THE PREFERRED EMBODIMENTS

Figure 1:
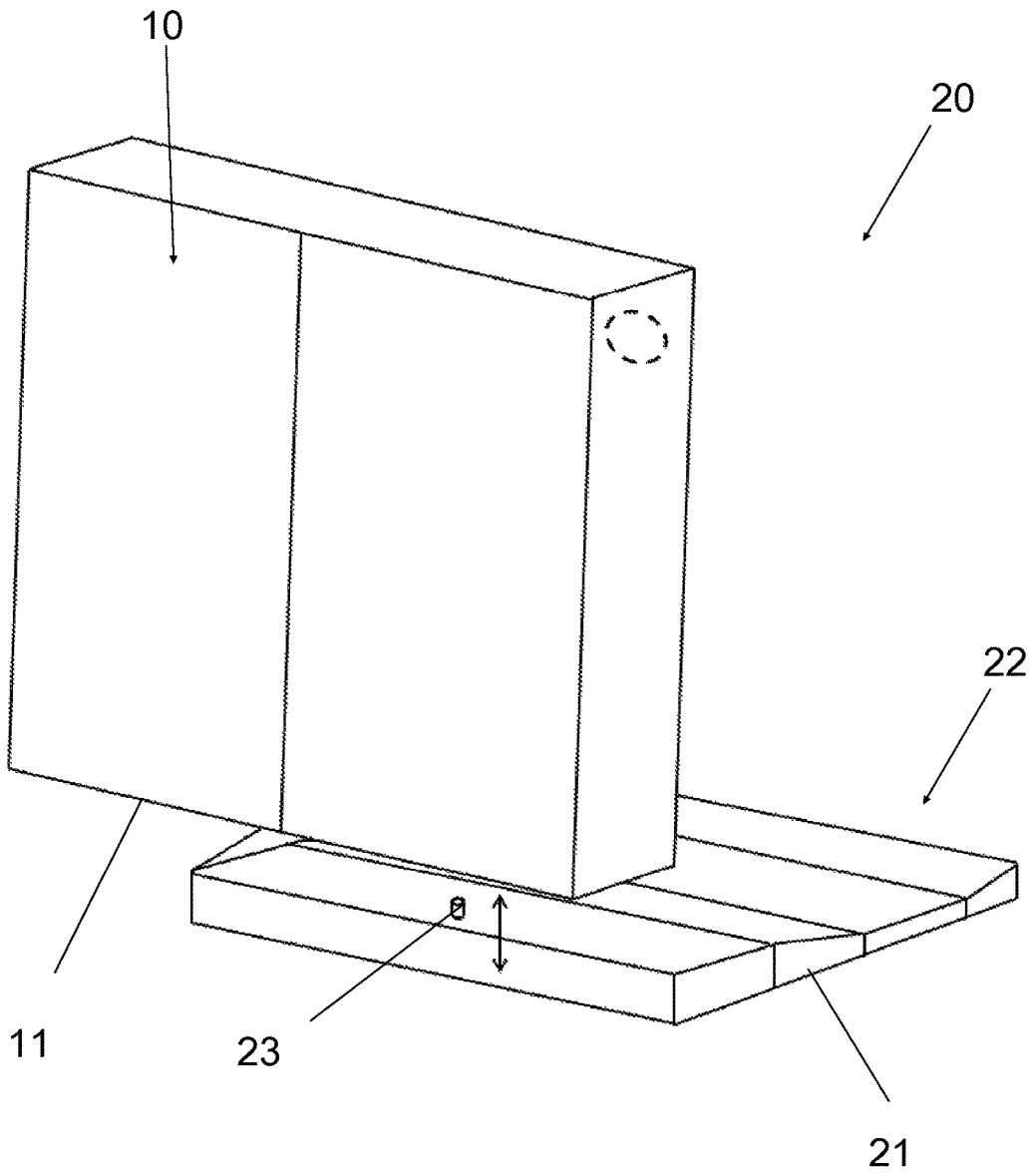
Figure 2:
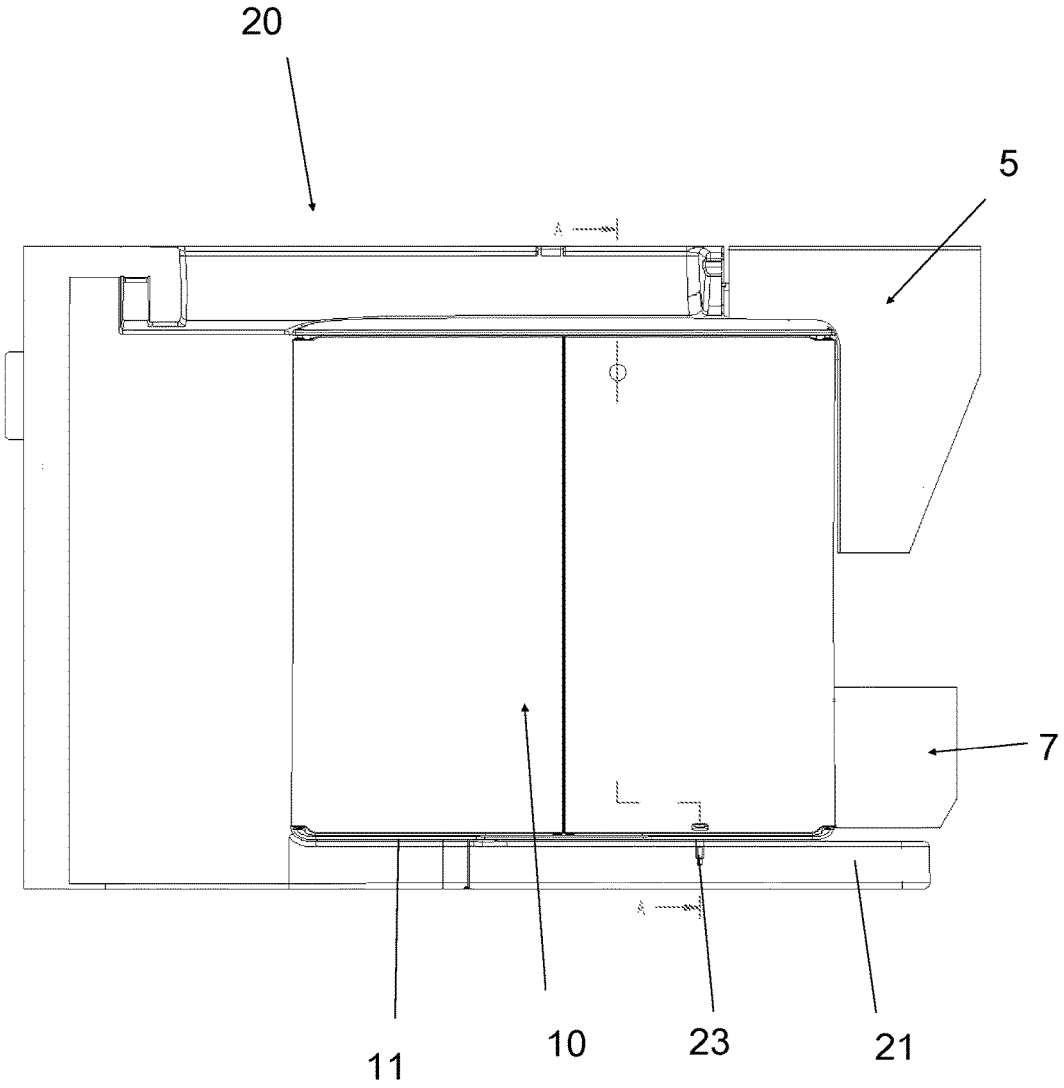

For better clarity, details of the sewing machine are not represented in the figures, since they are sufficiently known from the prior art, see for example CH707972 A1. FIG. 1 shows an accessories box 10 for a sewing machine 20. Of the sewing machine 20, only a part of the base 21 is visible in FIG. 1, which forms the foot element of the sewing machine 20. The base 21 lies for example on a table top, which forms the work surface. The base 21 has a concave curvature on its top surface in order to move a fabric being sewn underneath a free arm 7, partly represented in FIG. 2. The free arm 7 serves as a support for the sewing material. In the free arm 7 at least one spool for the bottom thread is received. The top thread is taken through a needle, not shown. This needle is driven via a needle bar by means of a drive mechanism located in the machine head. The needle and the needle bar perform oscillating motions, during which the needle pierces the sewing material lying on the free arm 7. The needle has a needle eye through which the top thread is led. The top thread upon piercing the sewing material arrives at a position beneath the stitch plate. Beneath the stitch plate, the top thread is knotted with a bottom thread led inside the free arm 7. Thanks to the knotting of the top thread with the bottom thread, a seam can be produced on the sewing material.

The accessories box 10 forms, with the base 21, a fastening device 30. The accessories box 10 has a bottom element 11, which is designed for support against the base 21 of the housing 22 of the sewing machine 20 or for support against a work surface, if the accessories box 10 is separated from the sewing machine 20.

Figure 3:
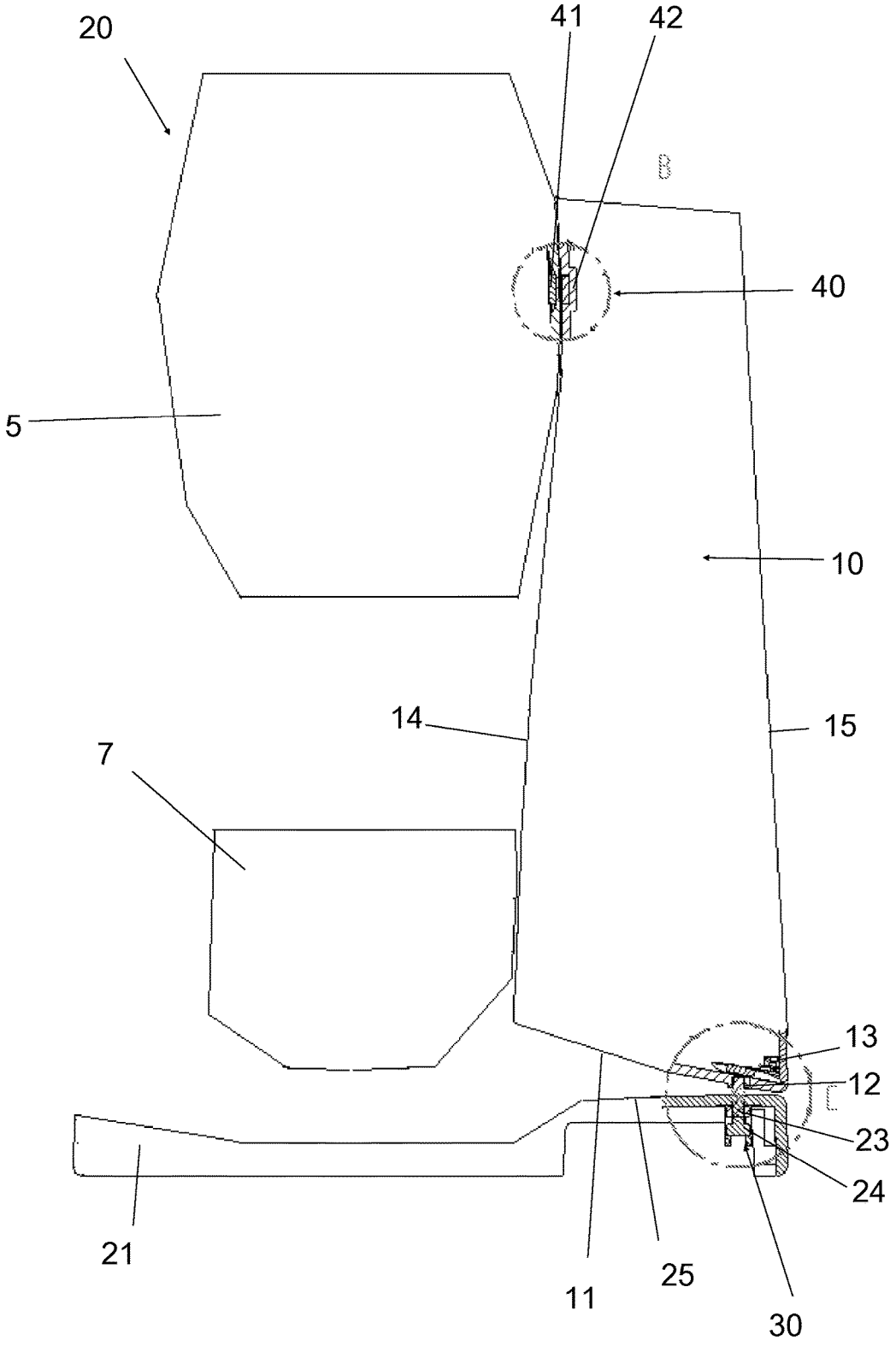

FIG. 3 shows a cross section through the free arm 7 and the machine head 5 of a sewing machine 20, on the rear side of which is arranged an accessories box 10. The accessories box 10 is likewise shown in cross section, but only a detail B and a detail C are represented more closely. Detail B is shown enlarged in FIG. 5. Detail C is shown enlarged in FIG. 4. The accessories box 10 comprises a first wall element 14 and a second wall element 15. The first wall element 14 is situated opposite the sewing machine 20. The second wall element 15 is situated opposite the first wall element 14 and forms in the assembled state a part of the rear side of the sewing machine 20.

Between the first wall element 14 and the second wall element 15 there extends the bottom element 11, which forms the bearing surface of the accessories box 10 on the base 21 of the housing 22 of the sewing machine 20.

Figure 4:
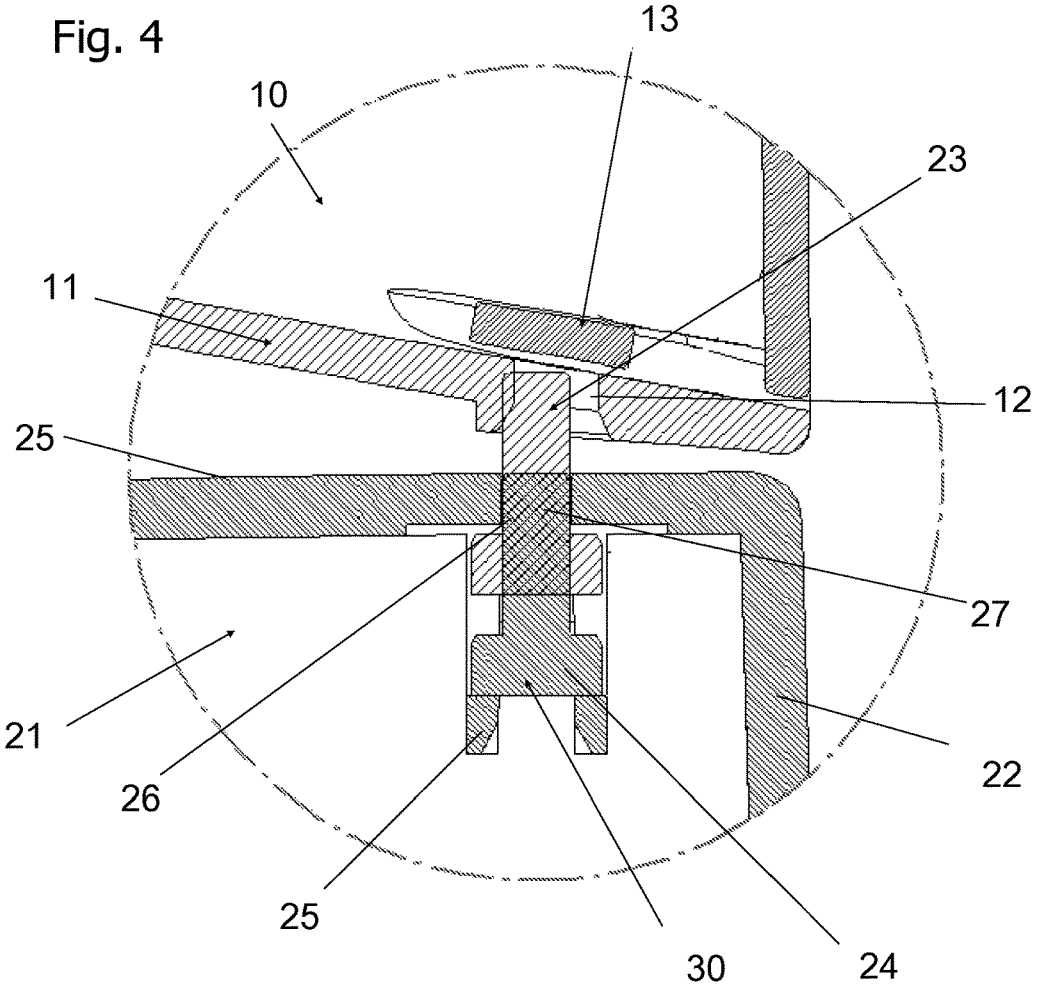

As is represented in FIG. 3 and FIG. 4, the bottom element 11 has a recess 12, in which a magnetic element or a magnetizable element 13 is housed, the magnetic element or the magnetizable element 13 being held in the recess 12 to receive a mating element 23. The mating element 23 can be attracted by the magnetic element or by the magnetizable element 13 and drawn into the recess 12, so that the mating element 23 can be received by the recess 12. The depth of the recess 12 here is less than the length of the mating element 23, so that a part of the mating element 23 is held in the base 21. Thanks to the mating element 23, which is held by the magnetic element or magnetizable element 13 in the recess 12 of the bottom element 11, the position of the accessories box 10 is established in relation to the sewing machine 20.

The mating element 23 is captively received in the base 21 of the sewing machine 20. The mating element 23 can have a body element 27, on whose underside a head element 24 is arranged. The thickness or the diameter of the body element 27 is smaller than the diameter of the head element 24.

The mating element 23 is led through a housing bore 26 of the housing 22, the mating element 23 having a body element 27 and a head element 24. The diameter of the housing bore 26 is less than the diameter of the head element 24.

Figure 5:
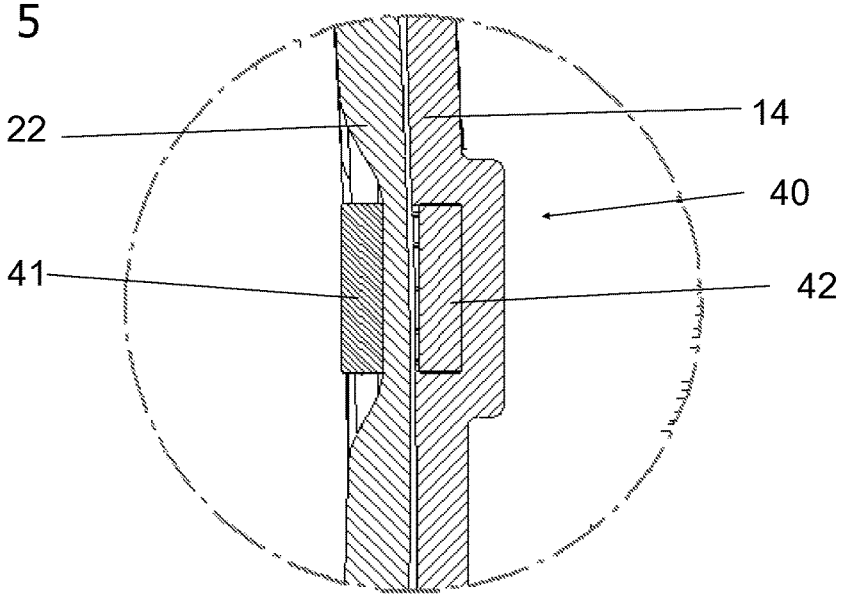

FIG. 3 and FIG. 5 show that the sewing machine 20 comprises a machine head 5. A fastening device 40 for the fastening of the accessories box 10 is arranged on the machine head 5. The fastening device 40 contains at least one magnetic element 41. The magnetic element 41 can be arranged in the housing of the machine head 5 or in the wall element 14. According to the present representation, the magnetic element 41 is arranged in the housing 22 of the sewing machine. The housing 22 encloses the machine head 5 at these places. The housing 22 can be a single piece or consist of several housing part elements which are joined together. The magnetic element 41 is associated with a mating element 42, the mating element 42 containing a magnetizable element. In particular, the magnetizable element can contain a ferromagnetic element.

Alternatively, the mating element 42 can contain a magnet. According to an example embodiment not represented, the magnetic element 41 can contain a ferromagnetic element. According to another example embodiment, instead of the magnetic element 41 one can use a magnetizable region of the housing 22 of the sewing machine, which can be fashioned in particular as a ferromagnetic region. In this case, however, one must make sure that the magnetic element 42 of the accessories box does not interfere with the stitch-forming device located in the machine head, since pliers, needles, needle bars and the like can be magnetizable. It is therefore necessary to arrange the fastening device 40 so that it is situated at sufficient distance from the stitch-forming device and also no interaction with magnetizable elements of the sewing material can occur, such as pins, zippers, or the like.

Figure 6:
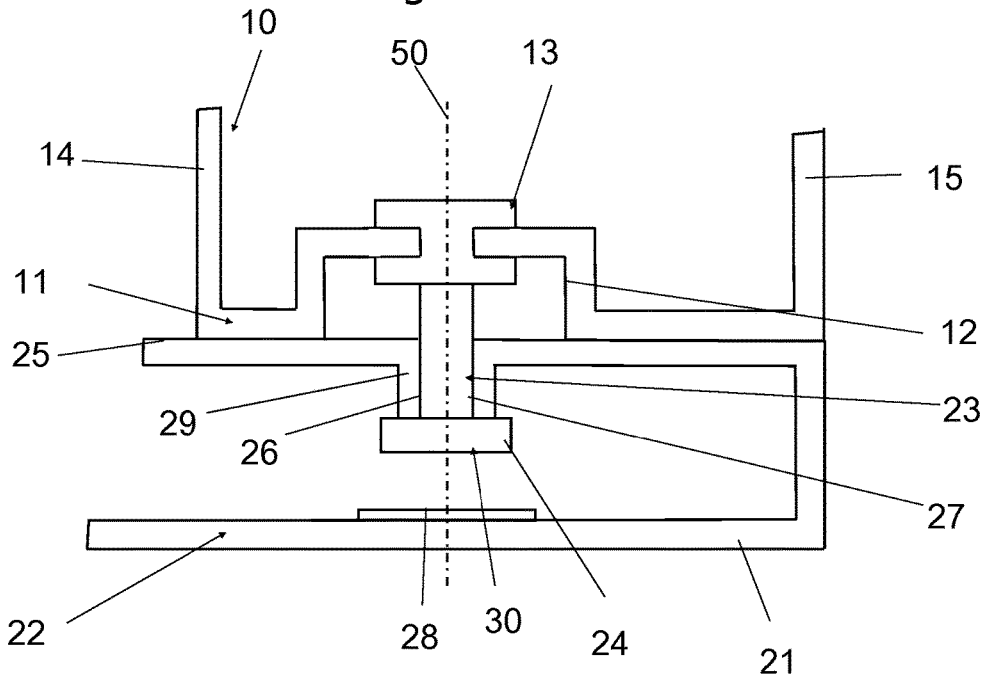

FIG. 6 shows a detail of a second example embodiment of a fastening device 30 in the locking position. In FIG. 6, only the lower part of the accessories box 10 is shown, so that the bottom element 11 as well as a part of the first wall element 14 and of the second wall element 15 of the accessories box 10 are visible. The bottom element 11 contains a recess 12, in which a magnetic element or a magnetizable element 13 is arranged. The magnetic element or magnetizable element 13 in the present example embodiment is fitted into the cover wall of the recess 12. According to an example embodiment not shown, the magnetic element or the magnetizable element 13 can also be held in the recess by a glue connection. An adhesive can be applied between the cover wall of the recess 12 and the surface of the magnetic element or the magnetizable element 13 facing the cover wall and the magnetic element or magnetizable element can be held by the adhesive in the recess 12. According to another example embodiment not represented, the cover wall of the recess 12 can have a conical recess, in which a frustum-shaped magnetic element or magnetizable element will be fitted. According to another example embodiment not represented, the magnetic element or magnetizable element can have a projection, which can be fitted into an opening located in the recess 12. The projection can have a snap mechanism. The projection can also have a slightly larger cross section than the opening, so that the magnetic element or the magnetizable element can be held in the opening by a press fit.

The fastening device 30 comprises a mating element 23, which can likewise be designed as a magnetic element or a magnetizable element. The mating element 23 can also be designed as a ferromagnetic element or contain a ferromagnetic region. As in the preceding example embodiment, the mating element 23 comprises a body element 27 and a head element 24. The cross section of the head element 24 normal to the lengthwise axis 50 is greater than the cross section of the body element 27. The mating element 23 is arranged in a housing bore 26 of the base 21 of the housing 22 of the sewing machine 20. The base 21 is only partially shown in the present representation, since the remaining construction of the base 21 conforms to the prior art and it is of no importance to the description of this invention how the base 21 is configured in the region of the free arm, not visible here, or the drive device of the sewing machine 20.

The housing bore 26 adjoins a neck 29, in which the body element 27 is movably mounted. The neck 29 serves to guide the mating element 23 in the direction of the lengthwise axis 50.

The mating element 23 is held in the present locked position by the magnetic element or magnetizable element 13. In this way, the position of the accessories box 10 relative to the base 21 is established. In FIG. 6, 7 the recess 12 has a much larger diameter than the body element 27. This makes possible a certain mobility of the accessories box relative to the base 21. This mobility can be limited by decreasing the diameter or the internal dimension of the recess 12 or prevented by a suitable choice of the diameter or the internal dimension. According to this example embodiment not represented, the walls of the recess are configured in accordance with the neck when no mobility of the accessories box 10 is desired in the locking position.

Figure 7:
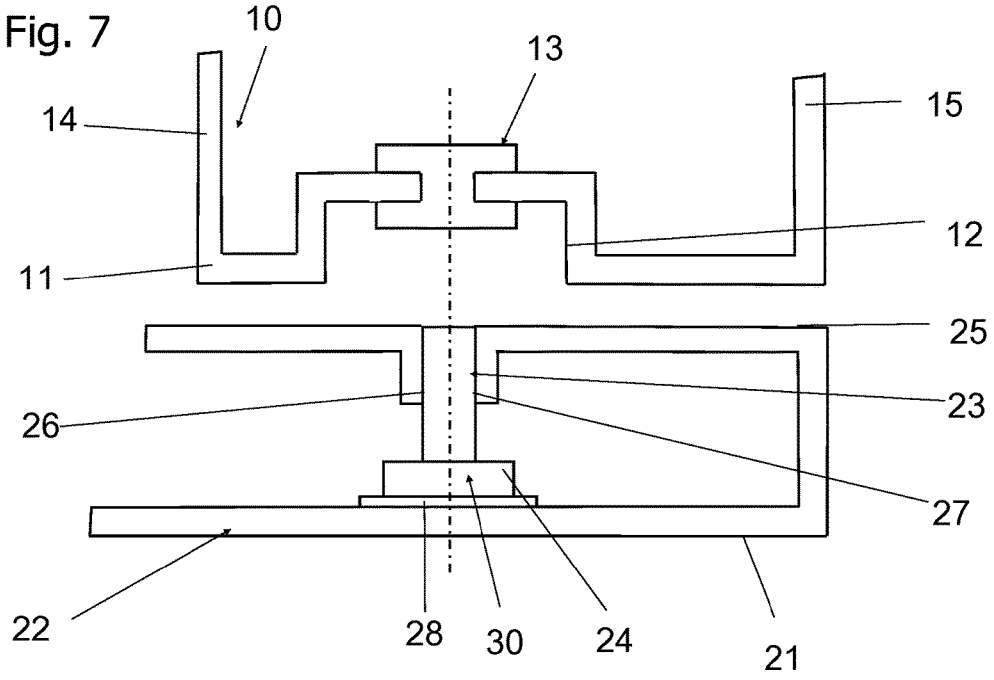

FIG. 7 shows a detail of a second example embodiment of a fastening device in the unlocked position. In the unlocked position, the accessories box 10 is removed from the base 21. As soon as the magnetic element or magnetizable element 13 is removed from the mating element 23, the action of the magnetic force on the mating element 23 disappears. The mating element 23 drops down under its own weight until it lies against the bearing element 28.

Figure 8:
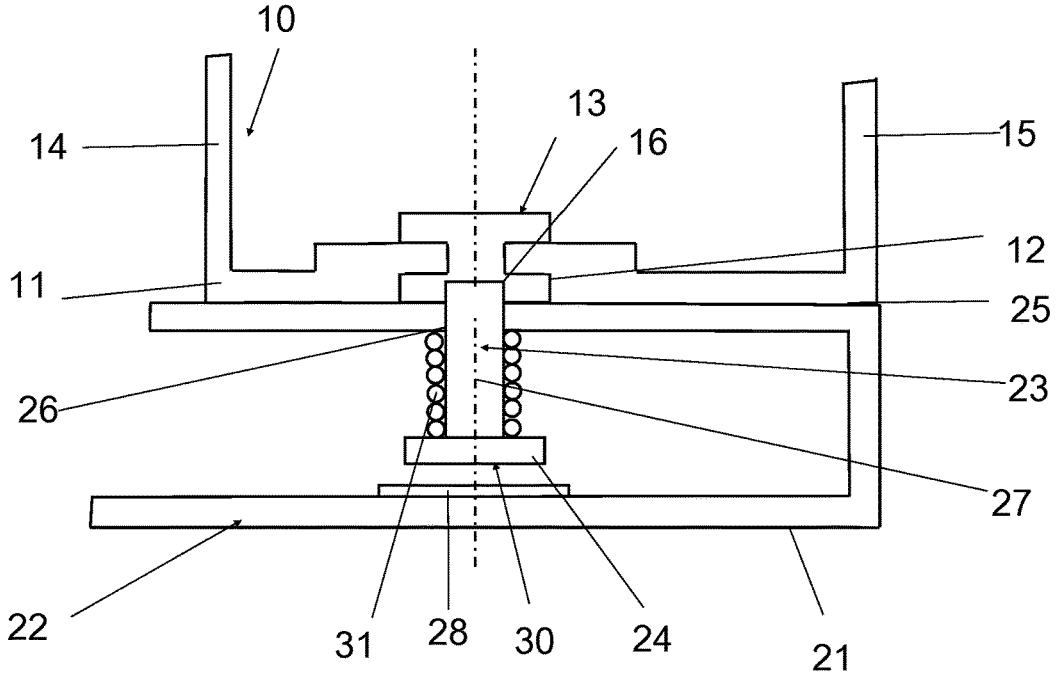

FIG. 8 shows a detail of a third example embodiment of a fastening device 30 in the locked position. In FIG. 8, only the lower part of the accessories box 10 is shown, so that the bottom element 11 as well as a portion of the first wall element 14 and the second wall element 15 of the accessories box 10 are visible. The bottom element 11 contains a recess 12, in which a magnetic element or a magnetizable element 13 is housed. The magnetic element or magnetizable element 13 in the present example embodiment is provided with a groove, in which a projection of the bottom element is received, forming the top side of the recess 12. In particular, the bottom side of the magnetic element or the magnetizable element 13 can be flush with the underside of the bottom element. According to an example embodiment not shown, the magnetic element or the magnetizable element 13 can also be held in the recess by a glue connection. An adhesive can be applied between the cover wall of the recess 12 and the surface of the magnetic element or the magnetizable element 13 facing the cover wall and the magnetic element or magnetizable element can be held by the adhesive in the recess 12. According to another example embodiment not represented, the cover wall of the recess 12 can have a conical recess, in which a frustum-shaped magnetic element or magnetizable element is press-fitted. According to another example embodiment not represented, the magnetic element or magnetizable element 13 can have a projection, which can be fitted into an opening located in the recess 12. The projection can have a snap mechanism. The projection can also have a slightly larger cross section than the opening, so that the magnetic element or the magnetizable element can be held in the opening by a press fit.

The magnetic element or magnetizable element 13 according to each of the example embodiments can have a recess 16 on the bottom side.

The fastening device 30 comprises a mating element 23, which can likewise be fashioned as a magnetic element or as a magnetizable element. The recess 16 serves to receive the mating element 23 in the locked state. The mating element 23 thus engages in the locked state with the magnetic element or magnetizable element 13, so that the accessories box 10 is secured against sliding on the base 21 of the housing 22. Therefore, the sewing machine can be safely transported together with the accessories box 10, without the accessories box 10 being able to slide or tip over. The mating element 23 can also be fashioned as a ferromagnetic element or have a ferromagnetic region. As in the preceding example embodiment, the mating element 23 comprises a body element 27 and a head element 24. The cross section of the head element 24 normal to the lengthwise axis 50 is larger than the cross section of the body element 27. The mating element 23 is arranged in a housing bore 26 of the base 21 of the housing 22 of the sewing machine 20. Between the base 21 and the head element 24 there can be arranged a spring element 31. The spring element 31 supports the return motion of the mating element 23 to a position in which it is recessed in the base 21, or does not protrude beyond the surface of the base 21.

The housing bore 26 as in the preceding example embodiment can adjoin a neck 29, in which the body element 27 is movably mounted. The neck 29 serves for additional guiding of the mating element 23 in the direction of the lengthwise axis 50. In addition, a spring element can be arranged between the neck 29 and the head element 24. The spring element can also run around the neck, which is not shown by the drawing.

The mating element 23 is held in the present locked position by the magnetic element or magnetizable element 13. In this way, the position of the accessories box 10 relative to the base 21 is established.

Figure 9:
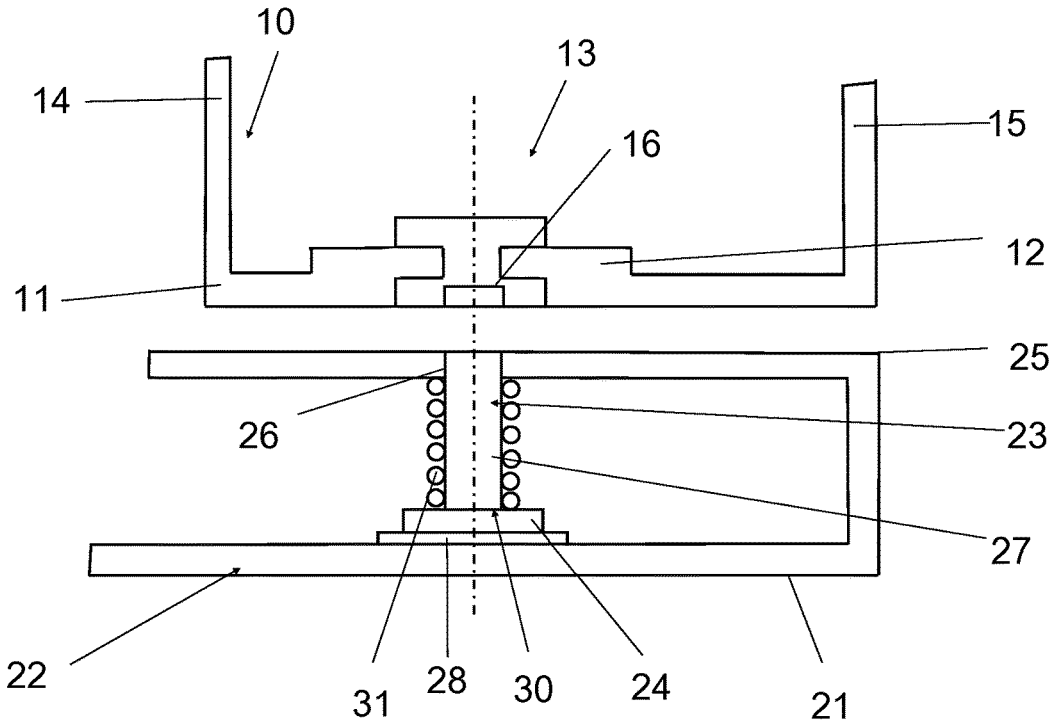

FIG. 9 shows a detail of the third example embodiment of a fastening device 30 in the unlocked position. In the unlocked position, the accessories box 10 is removed from the base 21. As soon as the magnetic element or magnetizable element 13 is removed from the mating element 23, the action of the magnetic force on the mating element 23 disappears. The mating element 23 drops down under its own weight, supported by the spring force acting due to the relaxation of the spring element 31, until it lies against the bearing element 28. The mating element 23 no longer extends beyond the cover surface 25. In this way, one can make sure on the one hand that the sewing material cannot sustain any damage and on the other hand that no interaction can occur with a pliers, a needle, a needle stand, pins, zippers, or the like.

The bearing element 28 can be eliminated if the base 21 has a correspondingly lower height. The mating element 23 in the unlocked position does not protrude beyond the cover surface 25 of the base 21.

Figure 10:
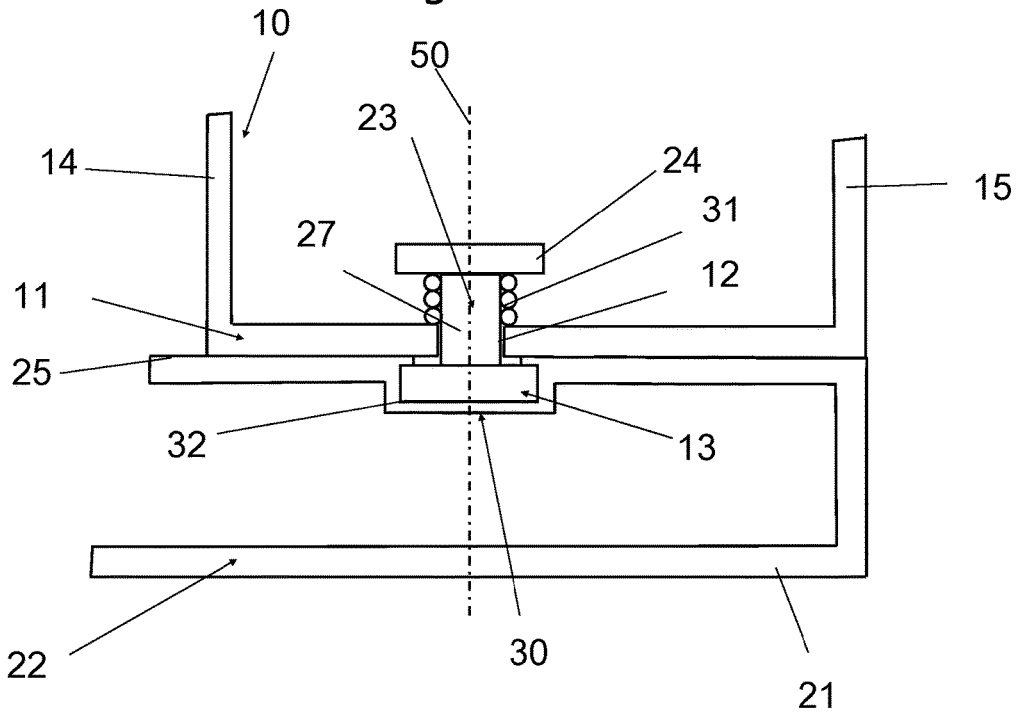

FIG. 10 shows a detail of a fourth example embodiment of a fastening device 30 in the locked position. In FIG. 10 only the lower part of the accessories box 10 is shown, so that the bottom element 11 as well as a portion of the first wall element 14 and the second wall element 15 of the accessories box 10 are visible. The bottom element 11 contains a recess 12, which is configured here as an opening, for example in the form of a through borehole. The recess houses a mating element 23. This mating element 23 comprises a head element 24 and a body element 27. The cross section of the head element 24 normal to the lengthwise axis 50 is larger than the cross section of the body element 27. The opening cross section of the recess 12 corresponds substantially to the cross section of the body element 27. Thus, the body element 27 is slidable and captively secured in the recess 12.

The mating element 23, especially the body element 27, can be fashioned as a magnet or a magnetizable element or contain a magnet or a magnetizable element. Between the head element 24 and the top side of the bottom element 11 there is arranged a spring element 31. The restoring force of the spring element is less than the force of attraction of the magnet, so that the mating element 23 can be held in the locked position.

In the base 21 there is likewise arranged a recess 32. In this recess 32 there is housed a magnetic element or a magnetizable element 13. The magnetic element or magnetizable element 13 in the present example embodiment is a cylindrical or polygonal disk-shaped body, which is received in the recess 32. In particular, the top side of the magnetic element or the magnetizable element 13 can be flush with the cover surface 25. According to an example embodiment not shown, the magnetic element or the magnetizable element 13 can also be held in the recess 32 by a glue connection. An adhesive can be applied between the cover wall of the recess 32 and the surface of the magnetic element or the magnetizable element 13 facing the cover wall and the magnetic element or magnetizable element can be held by the adhesive in the recess 32. According to another example embodiment not represented, the cover wall of the recess 32 can have a conical recess, in which a frustum-shaped magnetic element or magnetizable element is press-fitted. According to another example embodiment not represented, the magnetic element or magnetizable element 13 can have a projection, which can be fitted into an opening located in the recess 32. The projection can have a snap mechanism. The projection can also have a slightly larger cross section than the opening, so that the magnetic element or the magnetizable element 13 can be held in the opening by a press fit.

The magnetic element or magnetizable element 13 according to each of the example embodiments can have a recess 16 on the top side. The recess 16 serves to receive the mating element 23 in the locked state. The mating element 23 thus engages in the locked state with the magnetic element or magnetizable element 13, so that the accessories box 10 is secured against sliding on the base 21 of the housing 22. Therefore, the sewing machine together with the accessories box 10 can be safely transported, without the accessories box 10 being able to slip or tip over. The mating element 23 can also be fashioned as a ferromagnetic element or contain a ferromagnetic region.

The spring element 31 supports the return motion of the mating element 23 to a position in which it is fully received in the bottom element 11, or does not protrude beyond the bearing surface of the bottom element 11.

The recess 12 can adjoin a neck, in which the body element 27 is movably mounted. The neck serves for additional guiding of the mating element 23 in the direction of the lengthwise axis 50. The spring element 31 is arranged between the neck and the head element 24 or it can run around the neck, which is not shown by the drawing.

The mating element 23 is held in the present locked position by the magnetic element or magnetizable element 13. In this way, the position of the accessories box 10 relative to the base 21 is established.

Figure 11:
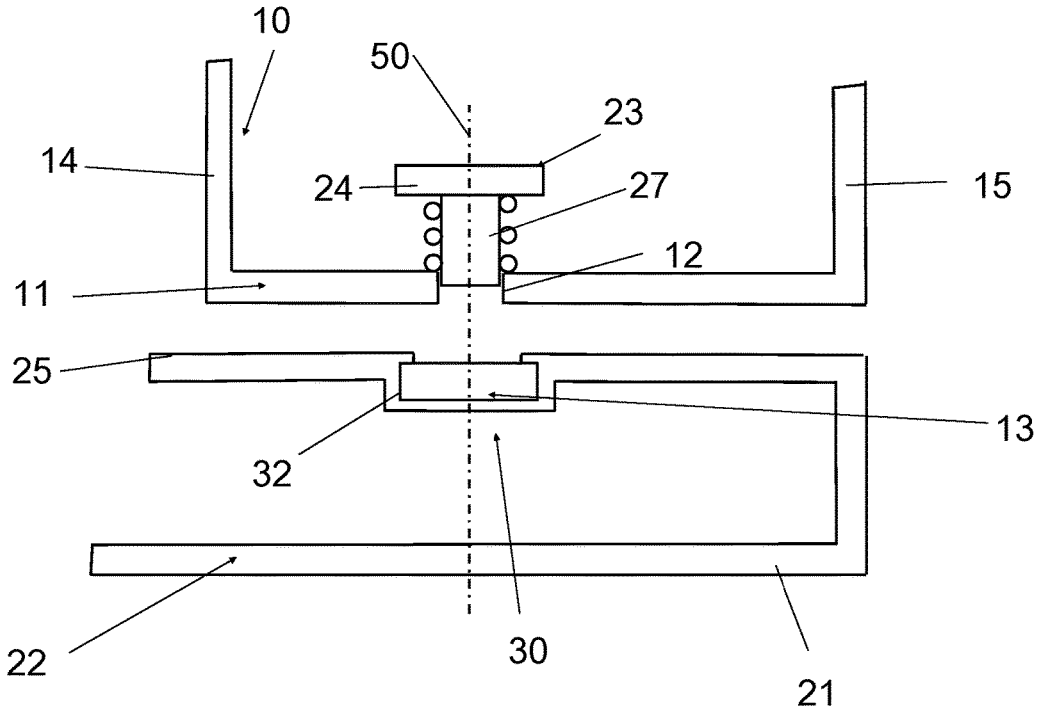

FIG. 11 shows a detail of the fourth example embodiment of a fastening device 30 in the unlocked position. In the unlocked position, the accessories box 10 is removed from the base 21. As soon as the magnetic element or magnetizable element 13 is removed from the mating element 23, the action of the magnetic force on the mating element 23 disappears. The mating element 23 is pulled upward by the relaxation of the spring element 31, i.e., into the interior of the accessories box 10, so that it does not extend beyond the bottom element 11 at any point of its bearing surface. In this way, one can assure that no interaction can occur with a pliers, a needle, a needle stand, pins, zippers, or the like.

The magnetic element or magnetizable element 13 is recessed in the cover surface 25 and can be flush with this cover surface. The magnetic element or magnetizable element 13 can also be covered by a protective layer or cap, so that the cover surface 25 has a smooth surface when the accessories box is separated from the sewing machine. In this way, one can avoid dirt getting into the recess 32. Furthermore, an elegant design of the base can be assured, since the recess 32 can be fully concealed. In this way, one can also ensure that no interaction can occur with a pliers, a needle, a needle stand, pins, zippers, or the sewing material.

The accessories box according to each of the preceding example embodiments can be provided with a plurality of first or second fastening devices 30, 40.

The mating element 23 can have a cross section from the group of circular, oval, polygonal, especially rectangular cross sections.

The accessories box according to each of the preceding example embodiments can thus be produced and used as a self-standing component with no additional feet or projecting and thus annoying parts in the area of the base of the sewing machine or in the area of the bottom element of the accessories box. The sewing area of the free arm of the sewing machine can thus remain free of projecting parts, sharp edges or the like. In this way, one can assure that the sewing material does not get caught and/or damaged.

Each of the fastening devices 30, 40 makes do entirely without snap connections, which besides the aforementioned technical drawbacks are also perceived as disruptive to the sewing machine design. Furthermore, the relatively large installation expense during the production of the accessories box and the sewing machine as well as during service activities, required due to the need for precision of the positioning, can be significantly reduced. If the snap connection is not exactly oriented or lies slightly outside the provided tight tolerance dimensions, movements of the snap element in its seat may result from the poor seating of the snap connection. These movements on the one hand can result in annoying noises on account of parts knocking together or even an unintentional loosening of the accessories box 10 from the base or machine head of the sewing machine. Since such snap connections are preferably made of plastic, the warping of the plastic parts forms yet another detrimental aspect of the snap connection which must be considered, all of which go away thanks to the use of a fastening device according to one of the example embodiments of the invention.

LEGEND FOR THE REFERENCE NUMBERS

5 Machine head
7 Free arm

10 Accessories box
11 Bottom element
12 Recess
13 Magnetic element or magnetizable element
14 Wall element
15 Wall element
16 Recess
20 Sewing machine
21 Base
22 Housing
23 Mating element
24 Head element
25 Cover surface
26 Housing borehole
27 Body element
28 Bearing element
29 Neck
30 Fastening device
31 Spring element
32 Recess
40 Fastening device
41 Magnetic element
42 Magnetic element
50 Lengthwise axis

The invention claimed is:

1. An accessories box (10) for a sewing machine (20), comprising a first fastening device (30), a bottom element (11), which is configured to bear against a base (21) of the sewing machine (20), the bottom element (11) comprises a recess (12), in which the fastening device (30) is received, the fastening device (30) contains a magnetic/magnetizable element (13) or a mating element (23)

wherein, so that a position of the accessories box (10) can be defined in relation to the sewing machine (20):

the magnetic/magnetizable element (13) is held in the recess (12) while the mating element (23) is movable within the recess (12) by the magnetic/magnetizable element (13), or the mating element (23) is held in the recess (12) while the magnetic/magnetizable element (13) is movable within the recess (12) by the mating element (23).

2. The accessories box (10) as claimed in claim 1, further comprising a first wall element (14) and a second wall element (15) both extending from the bottom element (11), the first wall element (14) configured to be arranged and fastened opposite a housing (22) of the machine head (5) of the sewing machine (20) by a second fastening device (40).

3. A system comprising:

a sewing machine (20) having a base (21);

an accessories box (10) including a bottom element (11), which is designed to bear against the base (21) of the sewing machine (20), the bottom element (11) comprises a recess (12); and a first fastening device (30) formed with the base (21) and the bottom element (11), the first fastening device (30) comprising a magnetic/magnetizable element (13) and a mating element (23), wherein one of the magnetic/magnetizable element (13) or the mating element (23) is housed in the recess (12).

4. The system as claimed in claim 3, wherein the mating element (23) contains a magnet or a ferromagnetic region.

5. The system as claimed in claim 4, wherein the mating element (23) is led through a housing borehole (26) of the housing (22) or through the recess (12) of the bottom element (11) of the accessories box (10).

6. The system as claimed in claim 3, wherein the mating element (23) comprises a body element (27) and a head element (24), and a cross section of the head element (24) is oriented normal to a lengthwise axis (50) of the mating element (23).

7. The system as claimed in claim 6, wherein the mating element (23) takes up a locking position when the accessories box (10) is positioned on the base (21) so that the magnetic/magnetizable element (13) is arranged substantially along the lengthwise axis (50) so that the mating element (23) is attracted by the magnetic/magnetizable element (13).

8. The system as claimed in claim 7, wherein the mating element (23) takes up an unlocking position when the accessories box is removed from the base (21) whereby the mating element (23) in the unlocking position does not extend beyond a cover surface (25) of the base (21) or a bearing surface of the bottom element (11).

9. The system as claimed in claim 7, wherein the first fastening device (30) contains a spring element (31).

10. The system as claimed in claim 3, the accessories box further comprising a first wall element (14) and a second wall element (15), the first wall element (14) being arranged opposite a housing (22) of the sewing machine (20); and a second fastening device (40) is arranged on the housing (22) for fastening to the first wall element (14) of the accessories box (10).

11. The system as claimed in claim 10, wherein the housing (22) that has the second fastening device (40) encloses a machine head (5) of the sewing machine (20).

* * * * *